US008564392B1

(12) United States Patent
Skinner et al.

(10) Patent No.: US 8,564,392 B1
(45) Date of Patent: Oct. 22, 2013

(54) IGNITION COIL

(75) Inventors: Albert A. Skinner, Waterford, MI (US); Harry O. Levers, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/460,990

(22) Filed: May 1, 2012

(51) Int. Cl.

| | |
|---|---|
| ***H01F 27/02*** | (2006.01) |
| ***H01F 21/06*** | (2006.01) |
| ***H01F 27/30*** | (2006.01) |
| ***H01F 38/12*** | (2006.01) |
| ***F02P 3/02*** | (2006.01) |

(52) U.S. Cl.
USPC ..... 336/90; 336/59; 336/60; 336/131; 336/198; 123/634; 123/635

(58) Field of Classification Search
USPC ..... 336/90, 59, 60; 123/634, 635
See application file for complete search history.

(56) References Cited

U.S. PATENT DOCUMENTS

| | | | | |
|---|---|---|---|---|
| 6,277,186 | B1 * | 8/2001 | Shi et al. | 106/205.72 |
| 6,522,232 | B2 * | 2/2003 | Paul et al. | 336/96 |
| 6,679,236 | B2 | 1/2004 | Skinner et al. | |
| 6,724,289 | B2 | 4/2004 | Moga et al. | |
| 6,845,764 | B1 | 1/2005 | Skinner et al. | |
| 6,980,073 | B2 * | 12/2005 | Wada | 336/90 |
| 7,228,853 | B1 | 6/2007 | Skinner et al. | |
| 7,984,707 | B2 * | 7/2011 | Anzo et al. | 123/634 |
| 2003/0034865 | A1 * | 2/2003 | Moga et al. | 336/90 |
| 2008/0276918 | A1 | 11/2008 | Skinner et al. | |

* cited by examiner

*Primary Examiner* — Elvin G Enad
*Assistant Examiner* — Kazi Hossain
(74) *Attorney, Agent, or Firm* — Thomas N. Twomey

(57) ABSTRACT

An ignition coil includes a central core, a primary winding, a spool, a secondary winding, and a case outward of the core, spool, primary winding, and secondary winding. The secondary winding is wound on the spool and includes a high voltage end. The ignition coil also includes a cup formed of a metal material in electrical communication with the high voltage end of the secondary winding and is configured to be contacted by a conductive connector that is suitable for connection to a spark plug. The cup includes a generally cylindrical first sidewall press fit with the case and defining a press fit area at the interface of the first sidewall and the case, a generally cylindrical second sidewall spaced radially from the first sidewall, and an annular space defined between the press fit area and the second sidewall.

13 Claims, 2 Drawing Sheets

IGNITION COIL

TECHNICAL FIELD OF INVENTION

The present invention relates to an ignition coil for developing a spark firing voltage that is applied to one or more spark plugs on an internal combustion engine; and more particularly to a high voltage cup terminal for such an ignition coil.

BACKGROUND OF INVENTION

Ignition coils are known for use in connection with an internal combustion engine such as an automobile engine. Ignition coils typically include a primary winding, a secondary winding, and a magnetic circuit. The magnetic circuit conventionally may include a central core extending along an axis and located radially inward of the primary and secondary windings and magnetically coupled thereto. The components are contained within a case formed of an electrical insulating material with an outer core or shield located outside of the case. One end of the secondary winding is conventionally configured to produce a relatively high voltage when a primary current through the primary winding is interrupted. In a common configuration, insulating resin or the like is introduced into the gap between the secondary winding and the case for insulating purposes. A high voltage cup in electrical communication with the high voltage end of the secondary winding may be press fit within the casing to facilitate coupling with a spark plug that is arranged to generate a discharge spark responsive to the high voltage. However, the area of press fit between high voltage cup and the case may be prone to a void in which an electrical field may concentrate.

What is needed is an ignition coil which minimizes or eliminates one or more of the shortcomings as set forth above.

SUMMARY OF THE INVENTION

Briefly described, an ignition coil is provided which includes a central core, a primary winding, a spool, a secondary winding, and a case surrounding the core, spool, primary winding, and secondary winding. The secondary winding is wound on the spool and includes a high voltage end. The ignition coil also includes a cup formed of a metal material in electrical communication with the high voltage end of the secondary winding and is configured to be contacted by a conductive connector that is suitable for connection to a spark plug. The cup includes a first cylindrical wall press fit with the case and defining a press fit area at the interface of the first annular wall and the case, a second cylindrical wall spaced radially from the first annular wall, and an annular space defined between the press fit area and the second annular wall.

BRIEF DESCRIPTION OF DRAWINGS

This invention will be further described with reference to the accompanying drawings in which.

DETAILED DESCRIPTION OF INVENTION

Figure 1:
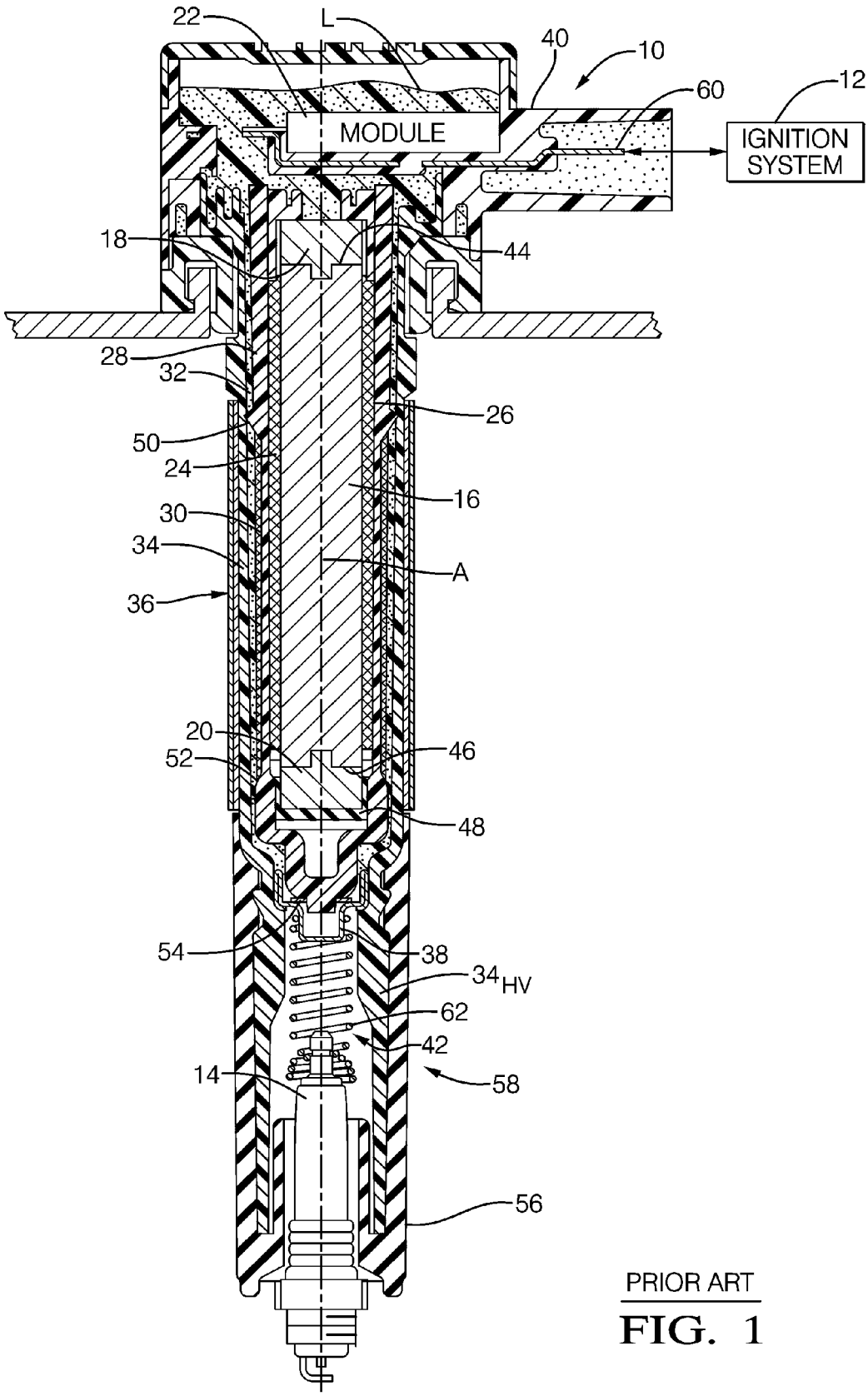
PRIOR ART FIG. 1
FIG. 1 is a simplified cross-section view of a prior art ignition coil.

Referring now to FIG. 1, a simplified cross-section view of a conventional ignition coil 10 is illustrated. As is generally known, ignition coil 10 may be coupled to, for example, an ignition system 12, which contains primary energization circuitry for controlling the charging and discharging of ignition coil 10. Further, the relatively high voltage produced by ignition coil 10 is provided to a spark plug 14 for producing a spark across a spark gap thereof, which may be employed to initiate combustion in a combustion chamber (not shown) of an internal combustion engine (also not shown). Ignition system 12 and spark plug 14 perform conventional functions well known to those of ordinary skill in the art. Ignition coil 10 is adapted for installation to the internal combustion engine through a spark plug well (not shown) onto a high-voltage terminal of spark plug 14 which may be retained by threaded engagement with a spark plug opening into the above-described combustion chamber. The internal combustion engine may provide power for locomotion of a self-propelled vehicle, such as an automotive vehicle.

FIG. 1 further shows a core 16, an optional first magnet 18, an optional second magnet 20, an electrical module 22, a primary winding 24, a first layer of insulating resin 26 (encapsulant) such as epoxy potting material, a secondary winding spool 28, a secondary winding 30, a second layer of insulating resin 32 (encapsulant) such as epoxy potting material, a case 34, a shield assembly 36, an electrically conductive cup 38, a low-voltage (LV) connector body 40, and a high-voltage (HV) connector assembly 42. Core 16 includes a top end 44 and a bottom end 46. FIG. 1 further shows a rubber buffer cup 48, annular spacer portions 50, 52 of secondary winding spool 28, a high-voltage (HV) terminal 54, and a spark plug boot 56.

Generally, core 16, primary and secondary windings 24, 30, and shield 36 (i.e. outer magnetic core) define a high voltage transformer assembly configured to generate a spark voltage for spark plug 14. Core 16 is elongated and includes a main, longitudinal axis A. Primary and secondary windings 24, 30 are generally radially outward of and surrounding core 16.

Case 34 is configured to house the transformer assembly and includes a high-voltage (HV) connection 58 at a first axial end thereof configured for direct mounting on spark plug 14 as shown. HV connection 58 is surrounded by high-voltage portion $\mathbf{34}_{HV}$ (e.g., as shown, the axially lowermost portion of case 34) and includes HV connector assembly 42 for electrically connecting to spark plug 14. Spark plug boot 56 surrounds high voltage portion $\mathbf{34}_{HV}$ and comprises electrical insulating material, such a silicone rubber.

With continuing reference to FIG. 1, further details concerning ignition coil 10 will now be set forth. It should be understood that portions of the following are exemplary only and not limiting in nature. Many other configurations are known to those of ordinary skill in the art and are consistent with the teachings of the present invention. Core 16 may be a conventional core known to those of ordinary skill in the art. As illustrated, core 16, in the preferred embodiment, takes a generally cylindrical shape (which is a generally circular shape in radial cross-section although other shapes such as ovals, rectangles, and other known shapes may also be used), and may comprise compression molded insulated iron particles or laminated steel plates, both as known.

Magnets 18 and 20 may be included in ignition coil 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition coil 10, and may be omitted, albeit with a reduced level of performance, which may be acceptable, depending on performance requirements.

Primary winding 24 may be wound directly onto core 16 in a manner known in the art. Primary winding 24 includes first and second ends and is configured to carry a primary current $I_p$ for charging ignition coil 10 upon control of ignition system 12. Primary winding 24 may be implemented using known approaches and conventional materials. Although not shown, primary winding 24 may be wound on a primary winding spool that surrounds core 16 in certain circumstances (e.g., when steel laminations are used).

First and second layers of insulating resin 26 and 32 comprise an encapsulant suitable for providing electrical insulation within ignition coil 10. In a preferred embodiment, the encapsulant comprises epoxy potting material. The epoxy potting material introduced in first and second layers of insulating resin 26 and 32 may be introduced into annular potting channels defined (i) between primary winding 24 and secondary winding spool 28, and, (ii) between secondary winding 30 and case 34. The potting channels are filled with potting material, in the illustrated embodiment, up to approximately the level designated "L" in FIG. 1. A variety of other thicknesses are possible depending on flow characteristics and insulating characteristics of the encapsulant and the design of ignition coil 10. The potting material also provides protection from environmental factors which may be encountered during the service life of ignition coil 10. There is a number of suitable epoxy potting materials well known to those of ordinary skill in the art.

Secondary winding spool 28 is configured to receive and retain secondary winding 30. Secondary winding spool 28 is disposed adjacent to and radially outward of and surrounding the central components comprising core 16, primary winding 24, and first layer of insulating resin 26 and preferably, is in coaxial relationship therewith. Secondary winding spool 28 may comprise any one of a number of conventional spool configurations known to those of ordinary skill in the art. In the illustrated embodiment, secondary winding spool 28 is configured to receive one continuous secondary winding 30 (e.g., progressive winding) on an outer surface thereof, as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings) as known.

The depth of secondary winding 30 in the illustrated embodiment may decrease from the top of secondary winding spool 28 (i.e., near the top end 44 of core 16), to the other end of secondary winding spool 28 (i.e., near the bottom end 46) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding 30, may require increased dielectric insulation between the secondary and primary windings 30, 24, and, may be provided for by way of the progressively increased separation between the secondary and primary windings 30, 24.

Secondary winding spool 28 is formed generally of electrical insulating material having properties suitable for use in a relatively high temperature environment. For example, secondary winding spool 28 may comprise plastic material such as PPO/PS (e.g., NORYL available from General Electric) or polybutylene terephthalate (PBT) thermoplastic polyester. It should be understood that there are a variety of alternative materials that may be used for secondary winding spool 28 known to those of ordinary skill in the ignition art, the foregoing being exemplary only and not limiting in nature.

Annular spacer portions 50, 52 of secondary winding spool 28 may be configured so as to engage an inner surface of case 34 to locate, align, and center the secondary winding spool 28 in the cavity of case 34.

As described above, secondary winding spool 28 includes an electrically conductive (i.e., metal) HV terminal 54 disposed therein configured to engage cup 38, which in turn is electrically connected to HV connector assembly 42. The body of secondary winding spool 28 at a lower end thereof is configured so as to be press-fit into the interior of cup 38 (i.e., the spool gate portion).

FIG. 1 also shows secondary winding 30 in cross-section. Secondary winding 30, as described above, is wound on secondary winding spool 28, and includes a low voltage end and a high voltage end. The low voltage end may be connected to ground by way of a ground connection through LV connector body 40 in a manner known to those of ordinary skill in the art. The high voltage end is connected to HV terminal 54. Secondary winding 30 may be implemented using conventional approaches and materials known to those of ordinary skill in the art.

Case 34 includes an inner, generally enlarged cylindrical surface, an outer surface, a first annular shoulder, a flange, an upper through-bore, and a lower through bore. The inner surface of case 34 is configured in size to receive and retain secondary winding spool 28 which contains the core 16 and primary winding 24. The inner surface of case 34 may be slightly spaced from secondary winding spool 28, particularly the annular spacer portions 50, 52 thereof (as shown), or may engage the annular spacer portions 50, 52.

A lower through bore of case 34 is defined by an inner surface thereof configured in size and shape (i.e., generally cylindrical) to provide a press fit with an outer surface of cup 38 at a lowermost portion thereof as described above. When the lowermost body portion of secondary winding spool 28 is inserted in the lower bore containing cup 38, HV terminal 54 engages an inner surface of cup 38 (also via a press fit).

Case 34 is formed of electrical insulating material, and may comprise conventional materials known to those of ordinary skill in the art (e.g., the PBT thermoplastic polyester material referred to above).

Shield 36 is generally annular in shape and is disposed radially outward of and surrounding case 34, and, preferably, engages an outer surface of case 34. Shield 36 preferably comprises electrically conductive material, and, more preferably metal, such as silicon steel or other adequate magnetic material. Shield 36 provides not only a protective barrier for ignition coil 10 generally, but, further, provides a magnetic path for the magnetic circuit portion of ignition coil 10. Shield 36 may nominally be about 0.50 mm thick, in one embodiment. Shield 36 may be grounded by way of an internal grounding strap, finger or the like (not shown) well known to those of ordinary skill in the art. Shield 36 may comprise multiple, individual sheets as shown.

LV connector body 40 is configured to, among other things, electrically connect the first and second ends of primary winding 24 to an energization source, such as, the energization circuitry included in ignition system 12. LV connector body 40 is generally formed of electrical insulating material, but also includes a plurality of electrically conductive output terminals 60 (e.g., pins for ground, primary winding leads, etc.). Terminals 60 are coupled electrically, internally through LV connector body 40, in a manner known to those of ordinary skill in the art, and are thereafter connected to various parts of ignition coil 10, also in a manner generally known to those of ordinary skill in the art.

HV connector assembly 42 may include a spring contact 62 or the like, which is electrically coupled to cup 38. Spring contact 62 is in turn configured to engage a high-voltage connector terminal of spark plug 14. This arrangement for coupling the high voltage developed by secondary winding 30 to spark plug 14 is exemplary only; a number of alternative connector arrangements, particularly spring-biased arrangements, are known in the art.

As described previously, cup 38 is press fit within case 34. Accordingly, as described in the Background Of The Invention section, any void that may be present in the press fit area between cup 38 and case 34 may allow an electrical field concentration in the press fit area.

Figure 2:
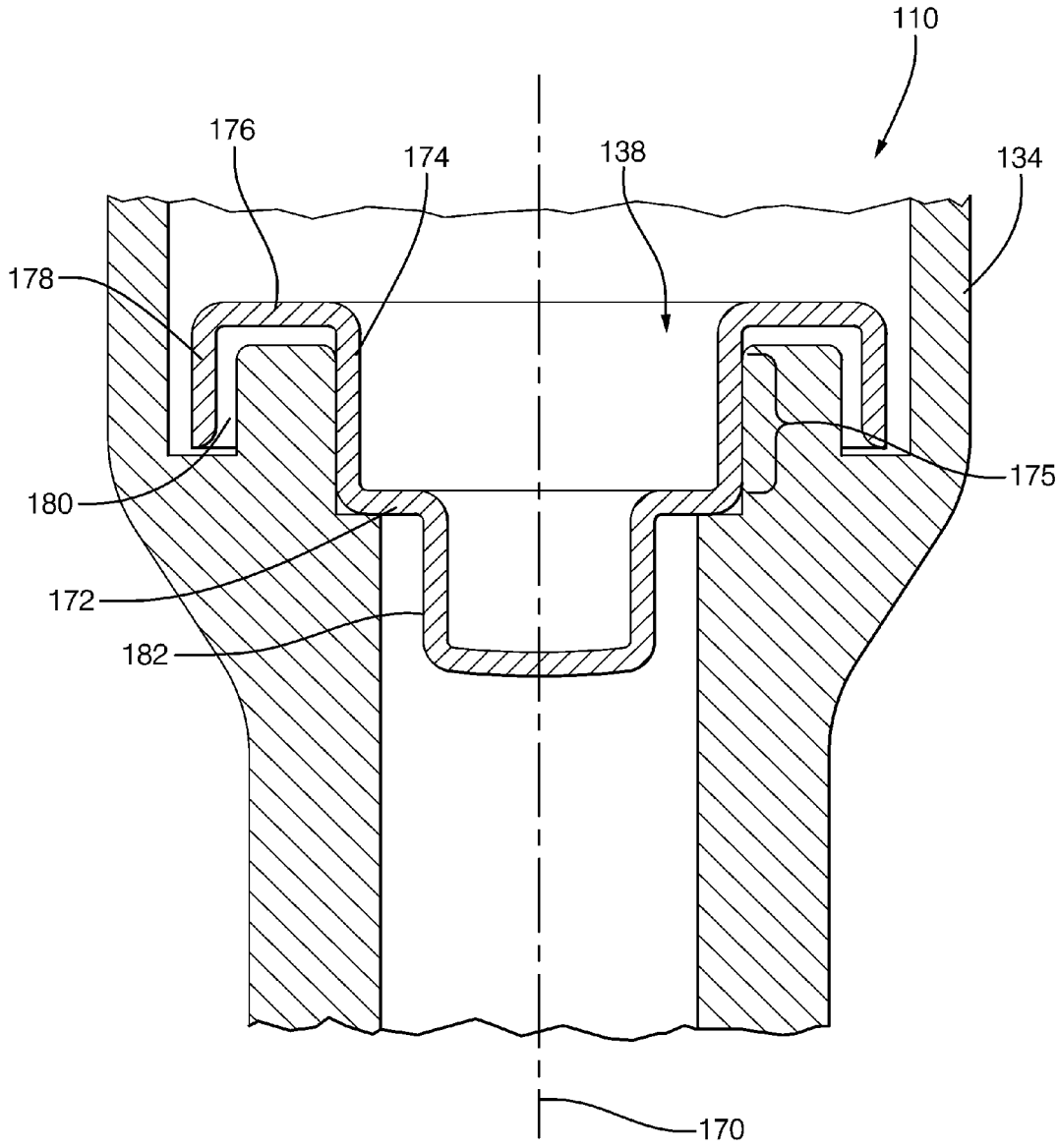
FIG. 2 is an enlarged cross-section view of a portion of an ignition coil in accordance with the invention.

In accordance with a preferred embodiment of the invention and now referring to FIG. 2, a portion of ignition coil 110 is shown to enlarge the area surrounding cup 138 in case 134. Only a portion of ignition coil 110 is shown since the other aspects of ignition coil 110 may be substantially the same in configuration as ignition coil 10 shown in FIG. 1. For clarity, FIG. 2 includes only case 134 and cup 138. As shown in FIG. 2, cup 138 serves the same function as cup 38 of FIG. 1, however, cup 138 is configured to minimize or eliminate the electrical field concentration at the press fit between cup 138 and case 134.

Cup 138 includes cup longitudinal axis 170 associated therewith. Cup 138 also includes cup base 172, and a generally cylindrical first sidewall 174 extending axially away from the outer circumference of cup base 172 in a first axial direction. Cup base 172 may be substantially perpendicular to cup longitudinal axis 170 as shown. The outer perimeter of first sidewall 174 is press fit with case 134 and defines a cylindrical press fit area 175 where first sidewall 174 interfaces with case 134. Cup 138 also includes cup top 176 which extends radially outward from the end of first sidewall 174 that is distal from cup base 172.

Cup 138 also includes a generally cylindrical second sidewall 178 extending axially away from cup top 176 in a second axial direction that is opposite from the first axial direction. In this way, second sidewall 178 radially surrounds at least a portion of first sidewall 174 and annular space 180 is defined between press fit area 175 and second sidewall 178. A portion of case 134 may occupy at least a portion of annular space 180. Second sidewall 178 extends to a length which is approximately at least axially even with the mid-point of press fit area 175 and may extend further, for example to a point that is axially even with cup base 172. While second sidewall 178 may extend to a length which is approximately at least even with the mid-point of press fit area 175, second sidewall 178 may alternatively extend to a length that is not even with the mid-point of press fit area 175 which may result in reduced effectiveness.

Cup 138 also includes a generally annular third sidewall 182 extending axially away from the inner circumference of cup base 172 in the second axial direction which is opposite from the first axial direction. Third sidewall 182 provides an area for the spring contact (not shown in FIG. 2, but described previously in reference to FIG. 1) to attach to cup 138. Alternatively, but not shown, third sidewall 182 may extend axially away from cup base 172 in the first direction as shown in U.S. Pat. No. 7,228,853 which is incorporated herein by reference in its entirety.

Cup 138 is made of a conductive material, for example, metal. Furthermore, cup 138 may be made using a stamping process which allows cup 138 to be constructed from a single piece of material thereby allowing uninterrupted electrical conductivity throughout cup 138. Alternatively, cup 138 may be made from a plurality of pieces and jointed together in such a way as to allow electrical communication from first sidewall 174 and second sidewall 178.

It is the inclusion of second sidewall 178 radially surrounding at least a portion of first sidewall 174 to define annular space 180 that minimizes or eliminates the electrical field concentration at the press fit between cup 138 and case 134. This is the result of second sidewall 178 being at the same electrical potential as first sidewall 174 which is press fit with case 134. Since second sidewall 178 is at the same electrical potential as first sidewall 174 due to the conductive nature and uninterrupted construction of cup 138, there is no electric field across press fit area 175 which would allow an electrical field concentration at the press fit between cup 138 and case 134.

While this invention has been described in terms of preferred embodiments thereof, it is not intended to be so limited, but rather only to the extent set forth in the claims that follow.

We claim:

1. An ignition coil comprising:
- a central core;
- a primary winding;
- a spool;
- a secondary winding wound on said spool and having a high voltage end;
- a case surrounding said core, said spool, said primary winding, and said secondary winding; and
- a cup formed of a metal material in electrical communication with said high voltage end of said secondary winding and configured to be contacted by a conductive connector that is suitable for connection to a spark plug;
- wherein said cup includes:
  - a generally cylindrical first sidewall press fit within said case and defining a press fit area at the interface of said first sidewall and said case;
  - a generally cylindrical second sidewall spaced radially from said first sidewall; and
  - an annular space defined between said press fit area and said second sidewall;
  - whereby said second sidewall minimizes or eliminates electric field concentrations at said press fit area.

2. An ignition coil as in claim 1 wherein said second sidewall radially surrounds at least a portion of said first sidewall.

3. An ignition coil as in claim 1 wherein said first sidewall is in electrical communication with said second sidewall.

4. An ignition coil as in claim 1 wherein said cup further includes a cup top extending radially outward from said first sidewall to said second sidewall to provide electrical communication between said first sidewall and said second sidewall.

5. An ignition coil as in claim 1 wherein a portion of said case occupies at least a portion of said annular space.

6. An ignition coil comprising:
- a central core;
- a primary winding;
- a spool;
- a secondary winding wound on said spool and having a high-voltage end;
- a case surrounding said core, said spool, said primary winding, and said secondary winding; and
- a cup formed of a metal material in electrical communication with said high-voltage end of said secondary winding and configured to be contacted by a conductive connector that is suitable for connection to a spark plug;
- wherein said cup includes:
  - a cup longitudinal axis;
  - a cup base;

a generally cylindrical first sidewall extending axially away from said cup base in a first axial direction and press fit with said case to define a press fit area at the interface of said first sidewall and said case;

a cup top which extends radially outward from the end of said first sidewall that is distal from said cup base;

a generally cylindrical second sidewall extending axially away from said cup top in a second axial direction that is opposite from said first axial direction;

whereby said second sidewall minimizes or eliminates electric field concentrations at said press fit area.

7. An ignition coil as in claim 6 wherein said second sidewall extends at least to the axial mid-point of said press fit area.

8. An ignition coil as in claim 6 wherein said second sidewall radially surrounds at least a portion of said first sidewall.

9. An ignition coil comprising:

a central core;

a primary winding;

a spool having a high-voltage terminal;

a secondary winding wound on said spool and having a high voltage end connected to said high-voltage terminal;

a case surrounding said core, said spool, said primary winding, and said secondary winding; and a cup formed of a metal material engaging said high-voltage terminal and configured to be contacted by a conductive connector that is suitable for connection to a spark plug;

wherein said cup includes:

a generally cylindrical first sidewall press fit within said case and defining a press fit area at the interface of said first sidewall and said case;

a generally cylindrical second sidewall spaced radially from said first sidewall; and an annular space defined between said first sidewall and said second sidewall;

whereby said second sidewall minimizes or eliminates electric field concentrations at said press fit area.

10. An ignition coil as in claim 9 wherein said second sidewall radially surrounds at least a portion of said first sidewall.

11. An ignition coil as in claim 9 wherein said first sidewall is in electrical communication with said second sidewall.

12. An ignition coil as in claim 9 wherein said cup further includes a cup top extending radially outward from said first sidewall to said second sidewall to provide electrical communication between said first sidewall and said second sidewall.

13. An ignition coil as in claim 9 wherein a portion of said case occupies at least a portion of said annular space.

* * * * *